US006727870B1

(12) United States Patent
Kim et al.

(10) Patent No.: US 6,727,870 B1
(45) Date of Patent: Apr. 27, 2004

(54) ELECTRODE STRUCTURE OF PLASMA DISPLAY PANEL AND METHOD OF DRIVING SUSTAINING ELECTRODE IN THE PLASMA DISPLAY PANEL

(75) Inventors: Won Tae Kim, Kumi-shi (KR); Young Chan Park, Kumi-shi (KR); Hun Gun Park, Kumi-shi (KR); Dae Kwan Seo, Daeku-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/657,183

(22) Filed: Sep. 7, 2000

(30) Foreign Application Priority Data

Sep. 7, 1999 (KR) ..... P1999-37781
Sep. 4, 2000 (KR) ..... P2000-52192

(51) Int. Cl.[7] ..... G09G 3/28
(52) U.S. Cl. ..... 345/60; 345/61; 345/68
(58) Field of Search ..... 345/60, 61, 68, 345/208, 210, 85; 349/12, 110, 141, 152; 445/24; 313/582

(56) References Cited

U.S. PATENT DOCUMENTS 5,893,624 A * 4/1999 Matsuhira et al. ..... 349/152
5,939,828 A * 8/1999 Matsuzaki et al. ..... 313/484
6,020,687 A * 2/2000 Hirakawa et al. ..... 385/135
6,069,446 A * 5/2000 Kim ..... 313/582
6,069,674 A * 5/2000 Aomori et al. ..... 345/81
6,113,449 A * 9/2000 Sung et al. ..... 430/315
6,162,107 A * 12/2000 Woo ..... 445/24
6,239,777 B1 * 5/2001 Sugahara et al. ..... 345/85
6,288,763 B1 * 9/2001 Hirota ..... 349/141
6,337,673 B1 * 1/2002 Ide et al. ..... 345/60
6,376,986 B1 * 4/2002 Takagi et al. ..... 313/582

FOREIGN PATENT DOCUMENTS

JP 9-231907 9/1997
JP 10-162744 * 6/1998 ..... 313/582
WO WO 00/44025 7/2000

* cited by examiner

*Primary Examiner*—Vijay Shankar
*Assistant Examiner*—Prabodh M. Dharia
(74) *Attorney, Agent, or Firm*—Fleshner & Kim, LLP

(57) ABSTRACT

An electrode structure of a plasma display panel and a method of driving sustaining electrodes in the plasma display panel that are capable of improving the brightness. In the electrode structure, refractive electrodes are connected to a sustaining electrode pair and are bent to generate a sustaining discharge at at least two positions within a cell.

27 Claims, 14 Drawing Sheets

ELECTRODE STRUCTURE OF PLASMA DISPLAY PANEL AND METHOD OF DRIVING SUSTAINING ELECTRODE IN THE PLASMA DISPLAY PANEL

BACKGROUND OF THE INVENTION

1. Field of the Invention

This invention relates to a plasma display panel, and more particularly to an electrode structure of a plasma display panel that is capable of improving the brightness. Also, the present invention is directed to a method of driving a sustaining electrode in the plasma display panel.

2. Description of the Related Art

Generally, a plasma display panel (PDP) is a light-emitting device which displays a picture using a gas discharge phenomenon within the cell. This PDP does not require providing an active device for each cell like a liquid crystal display (LCD). Accordingly, the PDP has a simple fabrication process and has the advantage of providing a large-dimension screen.

Such a PDP has a number of discharge cells arranged in a matrix type. The discharge cells are provided at each intersection between sustaining electrode lines for sustaining a discharge and address electrode lines for selecting the cells to be discharged. The PDP is largely classified into a direct current (DC) type panel and an alternating current (AC) type panel depending on whether or not a dielectric layer for accumulating a wall charge exists in the discharge cell.

Figure 1:
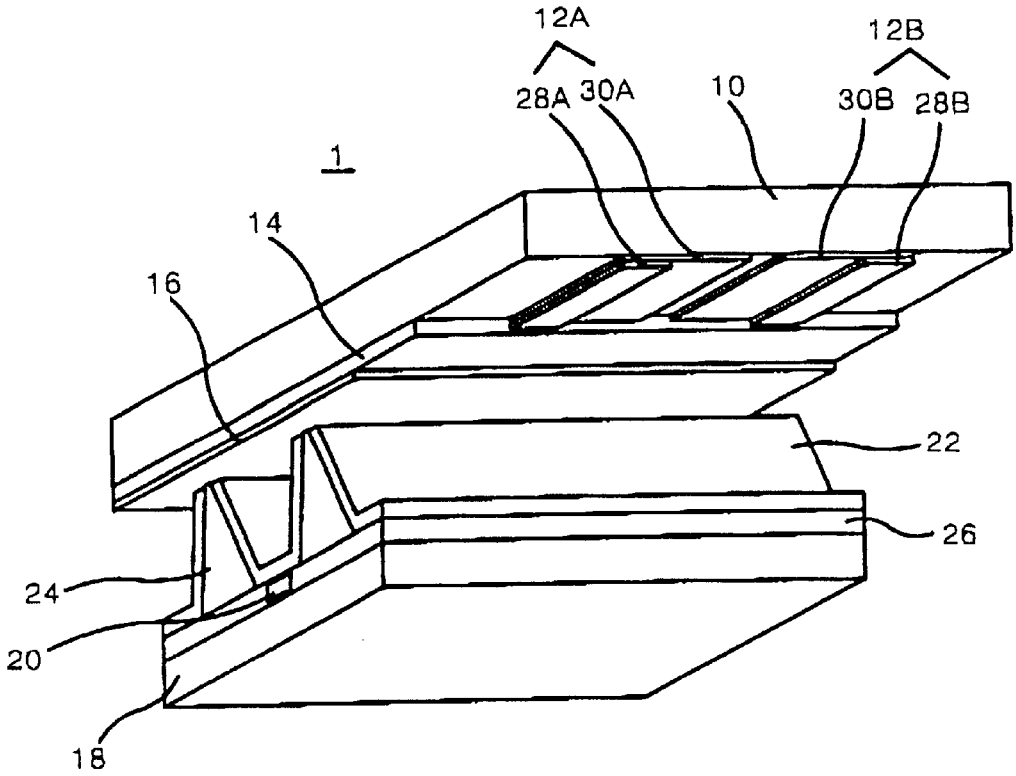
FIG. 1 PRIOR ART
Figure 2:
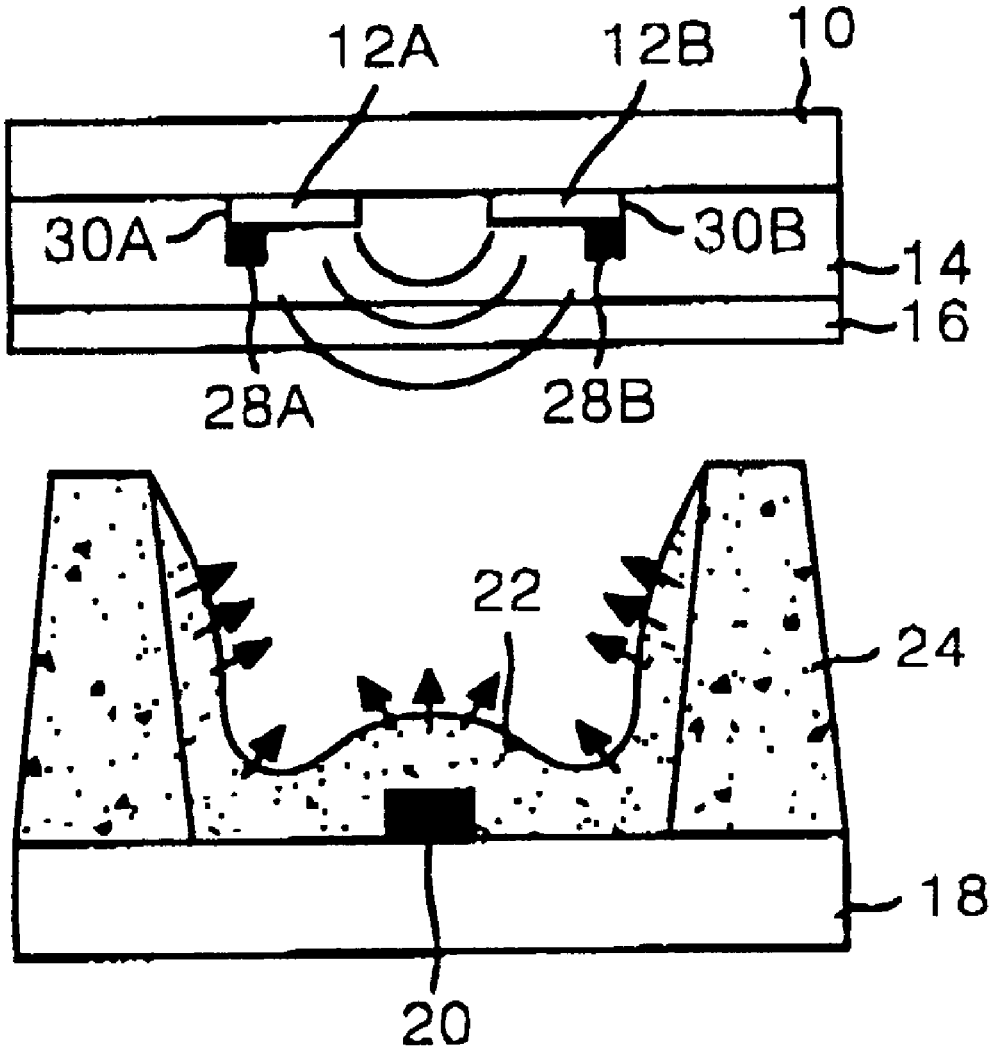
FIG. 2 PRIOR ART

Referring to FIG. 1 and FIG. 2, each cell of the AC-type, three-electrode PDP includes a front substrate 11 provided with a sustaining electrode pair 12A and 12B, and a rear substrate 18 provided with an address electrode 20. The front substrate 10 and the rear substrate 18 are spaced in parallel to each other with having barrier ribs 24 therebetween and sealed with a fritz glass. A mixture gas, such as Ne—Xe or He—Xe, etc., is injected into a discharge space defined by the front substrate 11, the rear substrate 18 and the barrier ribs 24. The sustaining electrode pair 12A and 12B makes a pair by two within a single of plasma discharge channel. Any one electrode of the sustaining electrode pair 12A and 12B is used as a scanning electrode that responds to a scanning pulse applied in an address interval to cause an opposite discharge along with the address electrode 20 while responding to a sustaining pulse applied in a sustaining interval to cause a surface discharge along with the other adjacent sustaining electrode. Also, the sustaining electrode 12B or 12A adjacent to the sustaining electrode 12A or 12B used as the scanning electrode is used as a common sustaining electrode to which a sustaining pulse is applied commonly.

The sustaining electrode pair 12A and 12B includes transparent electrodes 30A and 30B and metal electrodes 28A and 28B connected electrically to each other, respectively. The transparent electrodes 30A and 30B is formed by depositing indium thin oxide (ITO) on the front substrate 10 into an electrode width of about 300 m so as to prevent deterioration of an aperture ratio. The metal electrodes 28A and 28B are deposited on the front substrate 10 to have a three-layer structure of Ag or Cr—Cu—Cr. The metal electrodes 28A and 28B play a role to reduce a voltage drop caused by the transparent electrodes 30A and 30B.

On the front substrate 10 provided with the sustaining electrodes 12A and 12B, a dielectric layer 14 and a protective layer 16 are disposed. The dielectric layer 14 is responsible for limiting a plasma discharge current as well as accumulating a wall charge during the discharge. The protective film 16 prevents a damage of the dielectric layer 14 caused by the sputtering generated during the plasma discharge and improves the emission efficiency of secondary electrons. This protective film 16 is usually made from MgO. The rear substrate 18 is provided with a dielectric thick film 26 covering the address electrode 24. The barrier ribs 24 for dividing the discharge space are extended perpendicularly at the rear substrate 18. On the surfaces of the rear substrate 18 and the barrier ribs 24, a fluorescent material 22 excited by a vacuum ultraviolet lay to generate a visible light is provided.

Figure 3:
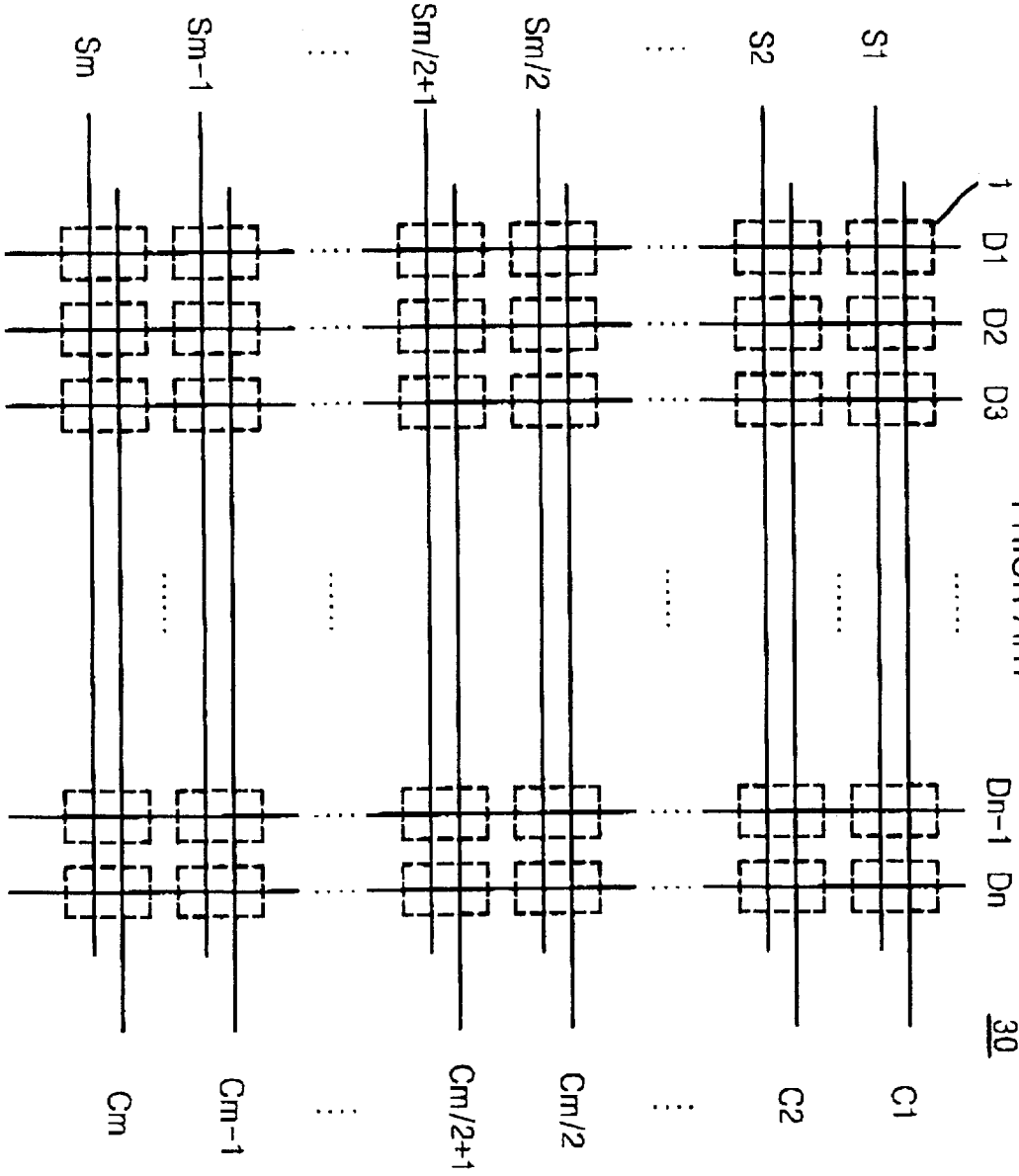
FIG.3 PRIOR ART
Figure 4:
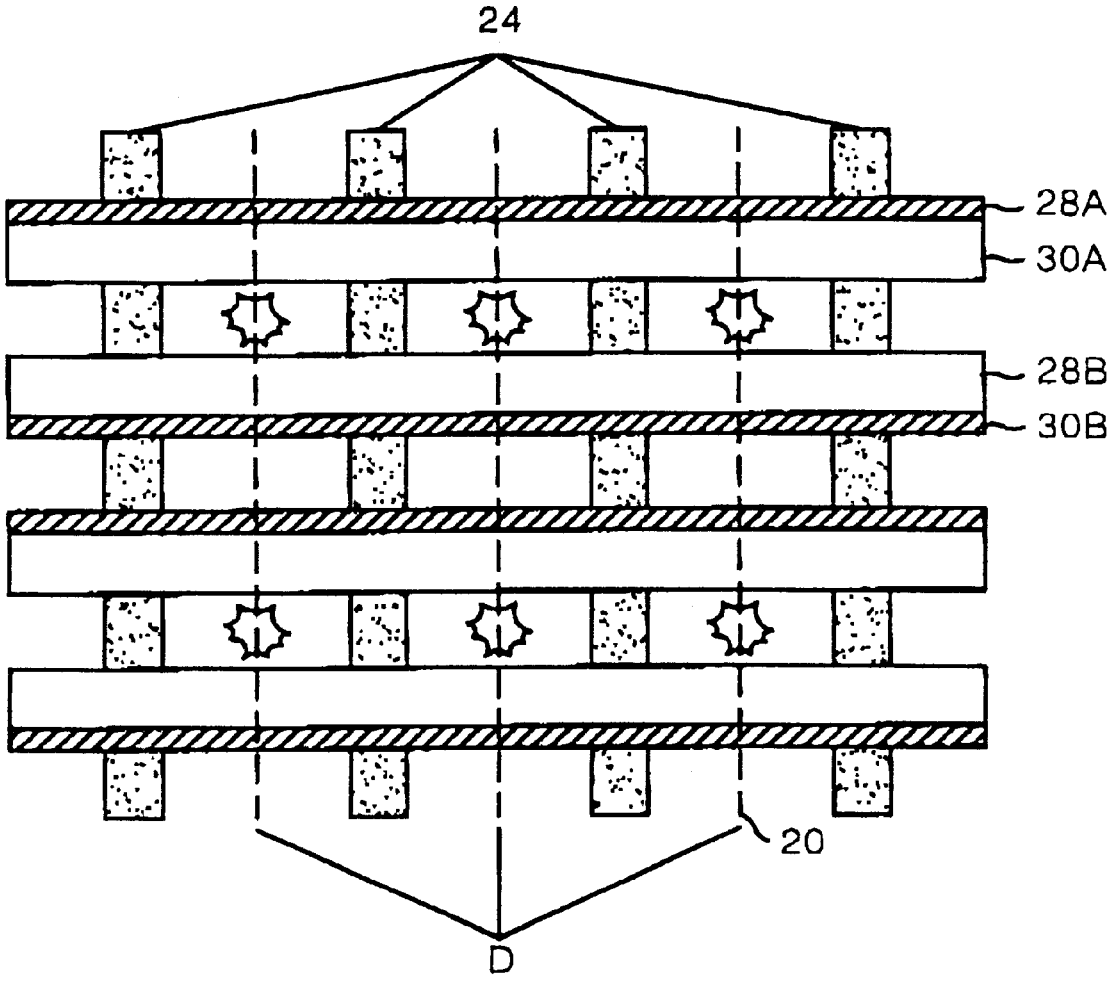
FIG. 4 PRIOR ART

As shown in FIG. 3, such cells 1 of the PDP are arranged on a panel 30 in a matrix type. In each cell 1, scanning/sustaining electrode lines S1 to Sm, common sustaining electrode lines C1 to Cm and address electrode lines D1 to Dn cross each other. The scanning/sustaining electrode lines S1 to Sm and the common sustaining electrodes C1 to Cm consists of the sustaining electrode pair 12A and 12B in FIG. 1, respectively. The address electrode lines D1 to Dn consist of the address electrodes 20.

In such an AC-type PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The cells on which a data is to be displayed are selected by a writing discharge in the address interval. The selected cells sustain the discharge in the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

An emission process of the PDP will be described below. First, a wall charge is uniformly accumulated within the cells of the entire screen by the reset discharge generated in the reset interval. In the address interval, a writing discharge is generated at the cells selected by an address discharge voltage applied to the scanning/sustaining electrode lines S1 to Sm and the address electrode lines D1 to Dn. Subsequently, when a sustaining pulse is alternately applied to the scanning/sustaining electrode lines S1 to Sm and the common sustaining electrode lines C1 to Cm, a discharge of the cells selected in the address interval is sustained.

When a plasma discharge is generated within the cell, a very small amount of electrons in discharge gases within the cell begin to be accelerated and continuously collide with neutral particles. By such an avalanche effect, the discharge gases within the cell is rapidly ionized into electrons and ions to be in a plasma state and, at the same time, generate a vacuum ultraviolet. This vacuum violet excites the fluorescent material 22 to generate a visible light.

However, the conventional PDP has a limit in improving the brightness into a satisfying level in view of its discharge structure. More specifically, the sustaining discharge of the PDP begins at one opposite surface between the scanning/sustaining electrode lines S1 to Sm and the common sustaining electrode lines C1 to Cm and is gradually diffused all over the cells. In such a discharge structure, since the discharge concentrates on only one surface between the scanning/sustaining electrode lines S1 to Sm and the common sustaining electrodes C1 to Cm, the brightness becomes low.

SUMMARY OF THE INVENTION

Accordingly, it is an object of the present invention to provide an electrode structure of a plasma display panel and a method of driving a sustaining electrode in the plasma display panel that are adaptive for improving the brightness.

In order to achieve these and other objects of the invention, an electrode structure of a plasma display panel according to one aspect of the present invention includes refractive electrodes connected to a sustaining electrode pair and bent to generate a sustaining discharge at at least two positions within a cell.

A method of driving sustaining electrodes in a plasma display panel according to another aspect of the present invention includes the steps of forming refractive electrodes at the sustaining electrode pair to generate a sustaining discharge at at least two positions within the cell.

DETAILED DESCRIPTION OF THE PREFERRED EMBODIMENT

Figure 5:
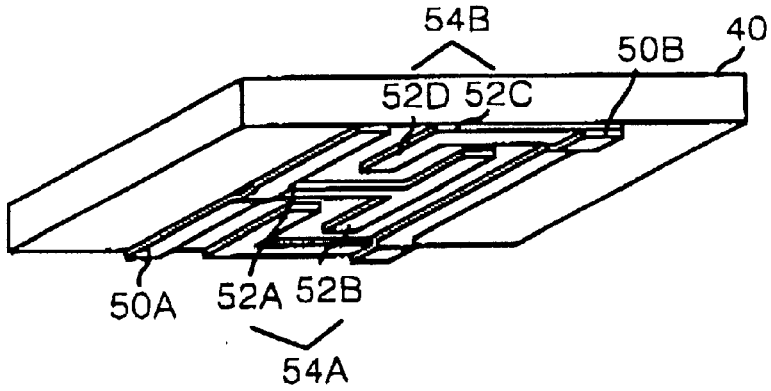
Figure 5:
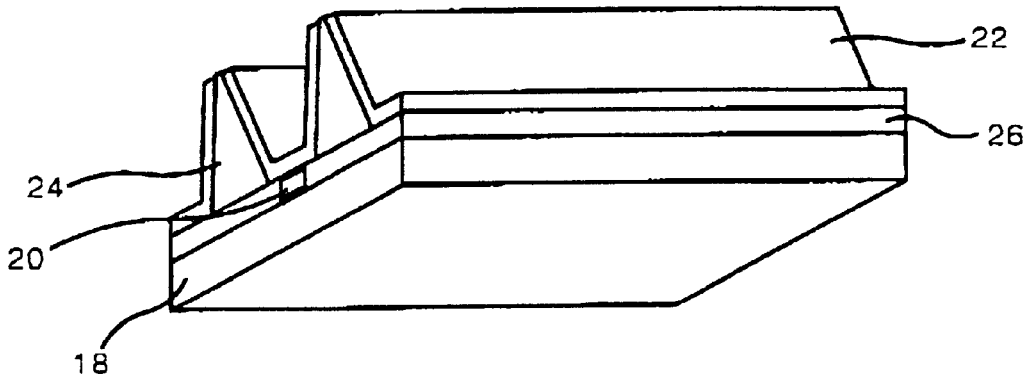
Figure 6:
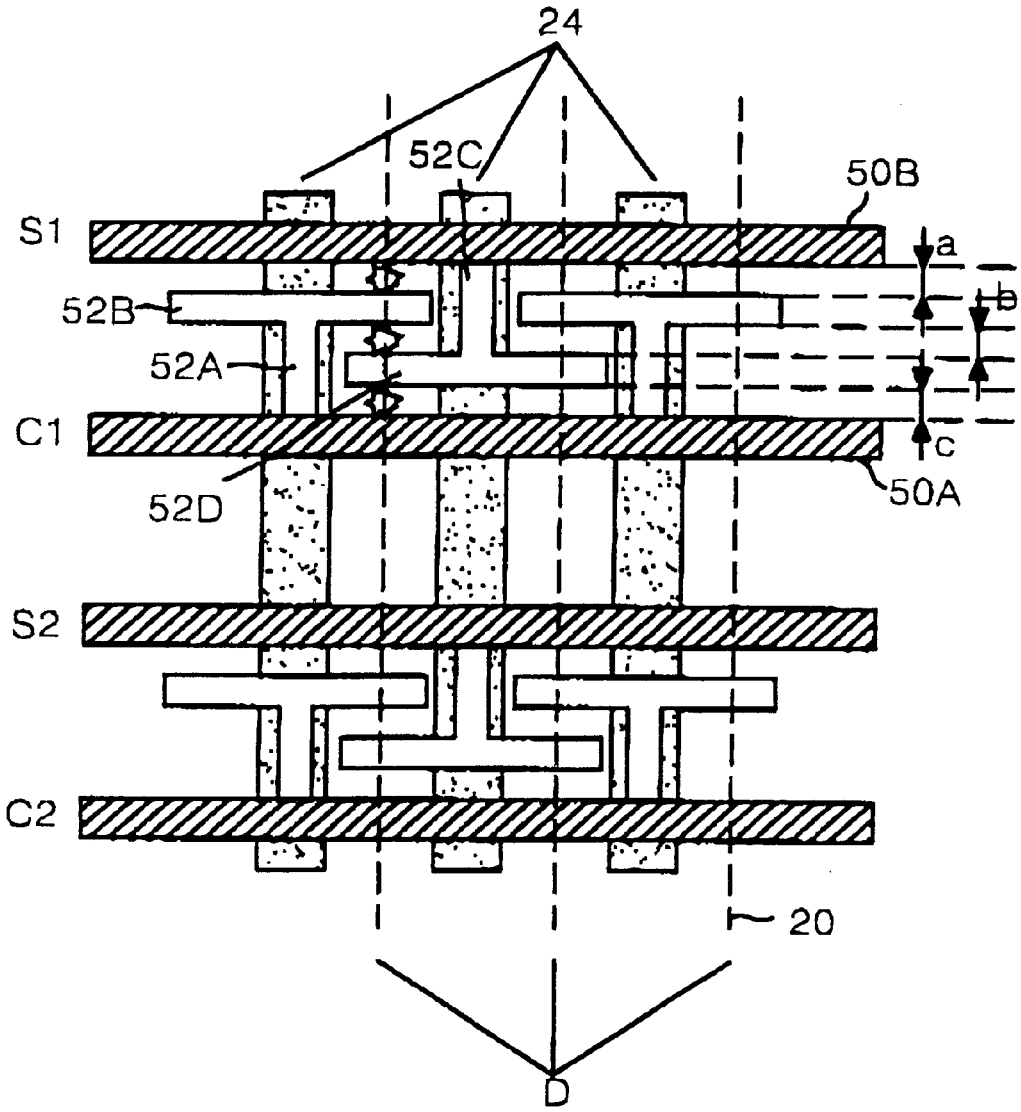

Referring to FIG. 5 and FIG. 6, there is shown an electrode structure of a plasma display panel (PDP) according to a first embodiment of the present invention. In FIG. 5 and FIG. 6, elements of the PDP having the same structure and function as those in FIG. 1 are given the same reference numerals. A detailed explanation as to said elements will be omitted.

Referring to FIG. 5, the PDP includes a front substrate 40 provided with refractive electrodes 54A and 54B connected to a sustaining electrode pair 50A and 50B, respectively, and a rear substrate 18 provided with an address electrode 20. Any one of the sustaining electrode pair 50A and 50B is used as a scanning electrode that responds to a scanning pulse applied in an address interval to cause an opposite discharge along with the address electrode 20 while responding to a sustaining pulse applied in a sustaining interval to cause a surface discharge along with the other adjacent refractive electrode. The other sustaining electrode 50A or 50B is used as a common sustaining electrode supplied commonly with a sustaining pulse. The refractive electrodes 54A and 54B is discharged mutually or discharged along with the sustaining electrode pair 50A and 50B to cause a discharge at a plurality of positions within the cell. Each of the sustaining electrode pair 50A and 50B has a three-layer structure of Ag(or Cr)—Cu—Cr.

Each of the refractive electrodes 54A and 54B is a transparent electrode patterned into a "T" shape. A material of the transparent is selected from a transparent conductive electrode material (e.g., ITO or indium zinc oxide (IZO)) that has a high transmissivity and a high electrical conductivity with respect to a light emitted from a fluorescent material 22. Alternately, the refractive electrodes 54A and 54B may be made from a metal electrode. The refractive electrodes 54A and 54B have first protrusions 52A and 52C connected to the sustaining electrode pair 50A and 50B, respectively, and second protrusions 52B and 52D bent in the longitudinal direction of the sustaining electrode pair 50A and 50B at the ends of the first protrusions 52A and 52C, respectively. Each of the first protrusions 52A and 52C are located at a position overlapping with a barrier rib 24, that is, at a boundary between the cells. On the front substrate 40 provided with the refractive electrodes 54A and 54B and the sustaining electrode pair 50A and 50B, a dielectric layer and a protective layer (not shown) are disposed as shown in FIG. 1.

In such a structure of the refractive electrodes 54A and 54B, as shown in FIG. 6, distances a and c between the sustaining electrode pair 50A and 50B and the second protrusions 52B and 52D are equal to a distance b between the second protrusions 52B and 52D. That is to say, a=b=c. Thus, if a sustaining voltage is applied to the sustaining electrode pair 50A and 50B, then a discharge is generated between the sustaining electrode pair 50A and 50B and the second protrusions 52B and 52D and, at the same time, a discharge is generated between the second protrusions 52B and 52D, and such a discharge is gradually diffused all over the cells. In other words, whenever a sustaining pulse is applied, a sustaining discharge is simultaneously initiated at three positions within the cell. If a sustaining discharge is simultaneously generated at various locations within the cell, then the brightness at a discharge initiation time is not only heightened to that extent, but also an emission efficiency and a utility factor of discharge space are improved.

On the other hand, if the distances a, b and C between the electrodes are not equal, then a discharge is first generated between the electrodes having the smallest distance between electrodes and thereafter a discharge is generated between the electrodes having a relatively larger distance between electrodes.

Figure 7:
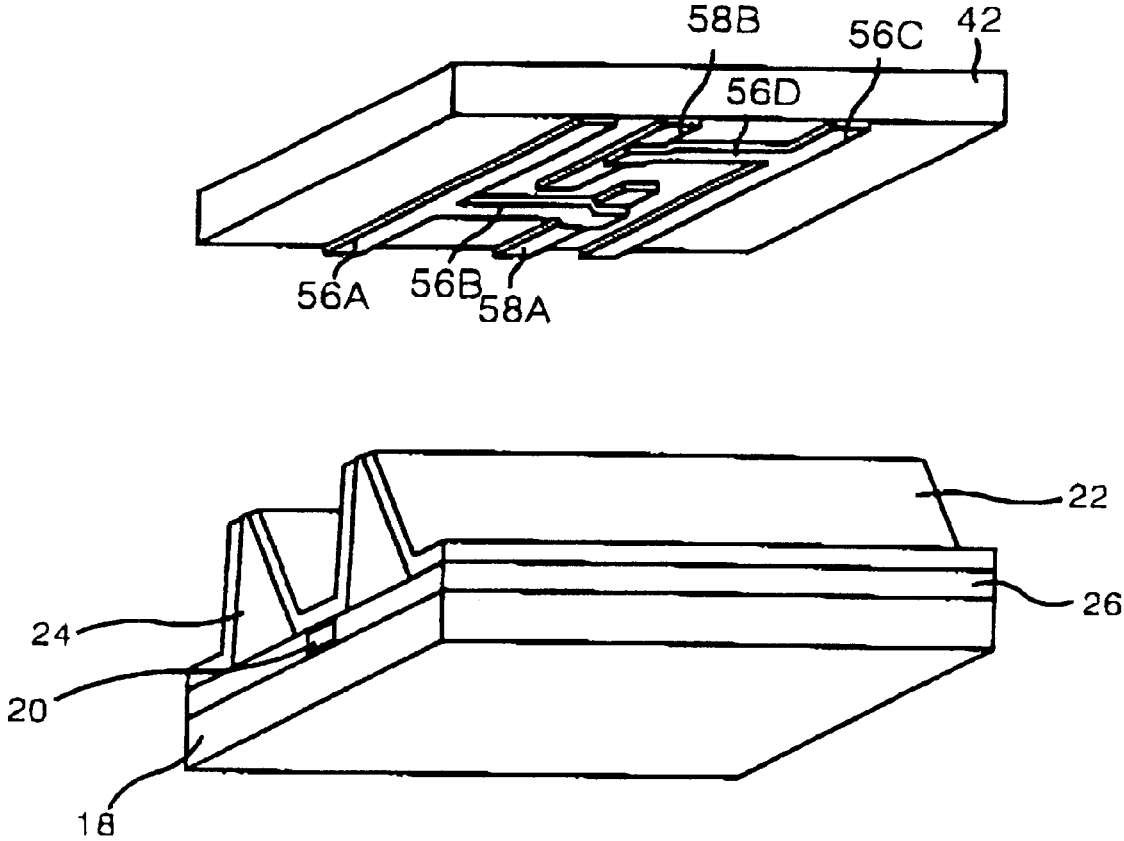
Figure 8:
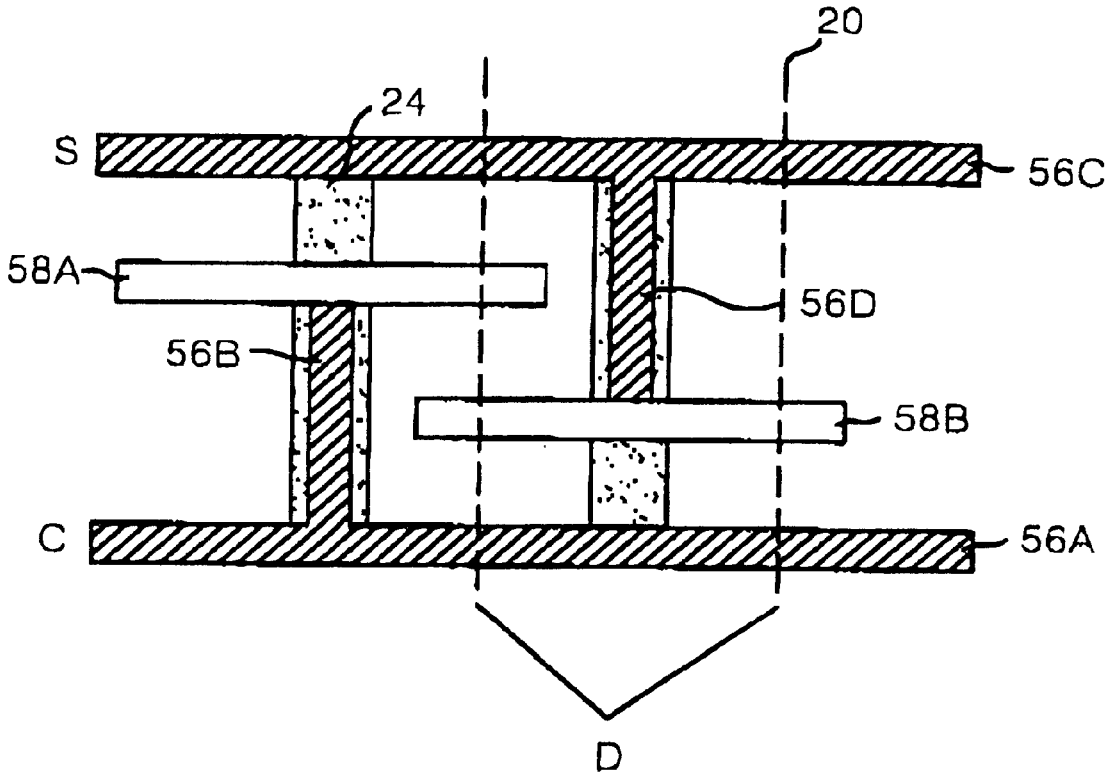

Referring to FIG. 7 and FIG. 8, there is shown an electrode structure of a plasma display panel (PDP) according to a second embodiment of the present invention. In FIG. 7 and FIG. 8, elements of the PDP having the same structure and function as those in FIG. 1 are given the same reference numerals. A detailed explanation as to said elements will be omitted.

Referring to FIG. 7, the PDP includes a sustaining electrode pair 56A and 56C having protrusions 56B and 56D extended in the width direction, and transparent electrodes 58A and 58B contacting the protrusions 56B and 56D and arranged in the longitudinal direction of the sustaining electrode pair 56A and 56C. The protrusions 56B and 56D of the sustaining electrode pair 56A and 56C play a role to reduce a voltage drop amount caused by the first protrusions 52A and 52C of the transparent electrodes 54A and 54B shown in FIG. 5 as well as to apply a voltage signal to the transparent electrodes 58A and 58B. These protrusions 56B and 56D are alternately formed at the opposite metal electrode pair 56A and 56C, and is vertically opposed to the barrier rib 24 to be positioned at a boundary between the cells. Thus, the protrusions 56B and 56D dose not interfere a visible light emitted from a fluorescent material 22 and progressing into the display screen. Such a sustaining electrode pair 56A and 56C has a three-layer structure of Ag(or Cr)—Cu—Cr. The transparent electrodes 54A and 54B is formed of a transparent conductive electrode material (e.g., ITO or IZO) in the longitudinal direction of the sustaining electrode pair 56A and 56C to simultaneously generate a sustaining discharge at a plurality of positions within the cell.

As shown in FIG. 8, distances a and c between the protrusions 56B and 56D of the sustaining electrode pair 56A and 56C are equal to a distance b between the transparent electrodes 58A and 58B. That is to say, a=b=c. Thus, if a sustaining voltage is applied to the sustaining electrode pair 56A and 56C, then a discharge is initiated simultaneously at the distances between the protrusions 56B and 56D and the transparent electrodes 58A and 58B and at the distance between the transparent electrodes 58A and 58B.

Referring to FIG. 9A through FIG. 11C, there are shown electrode structures of a plasma display panel (PDP) according to other embodiments of the present invention. In FIG. 9A to FIG. 11C, elements of the PDP having the same structure and function as those in FIG. 1 are given the same reference numerals. A detailed explanation as to said elements will be omitted.

Figure 9A:
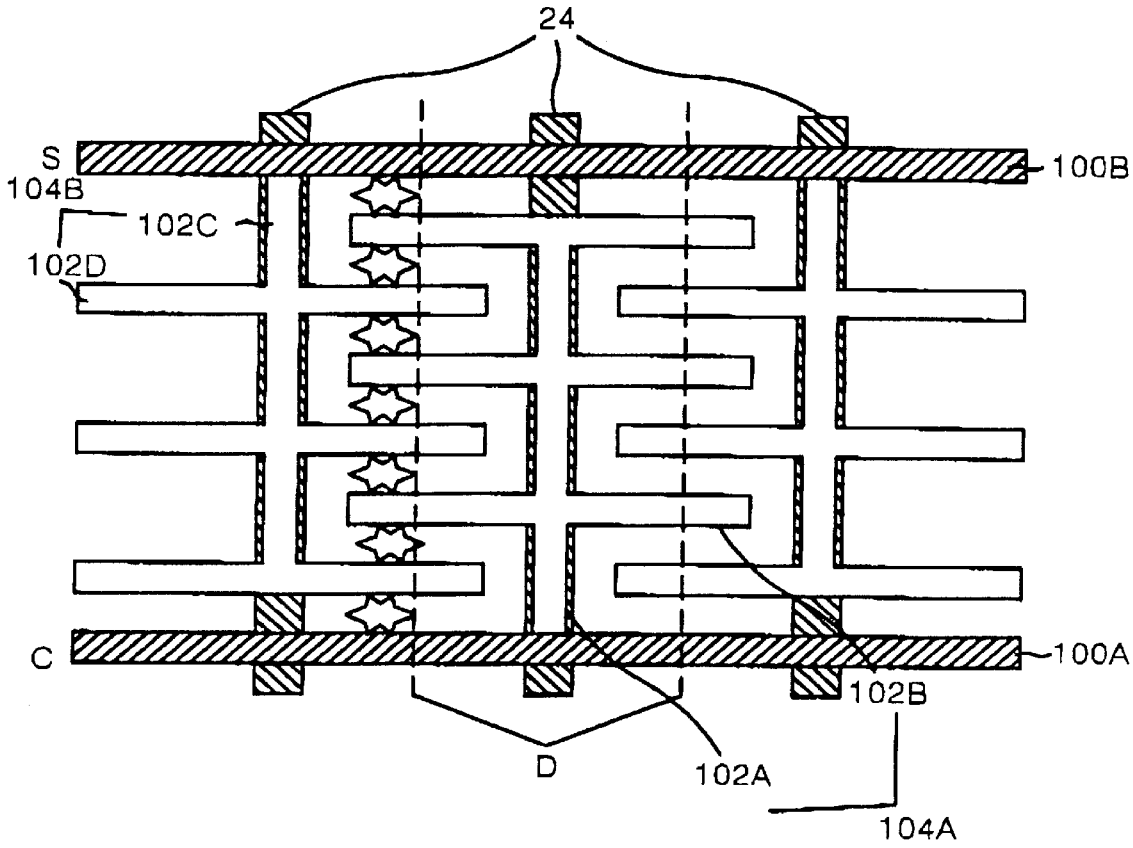
Figure 9B:
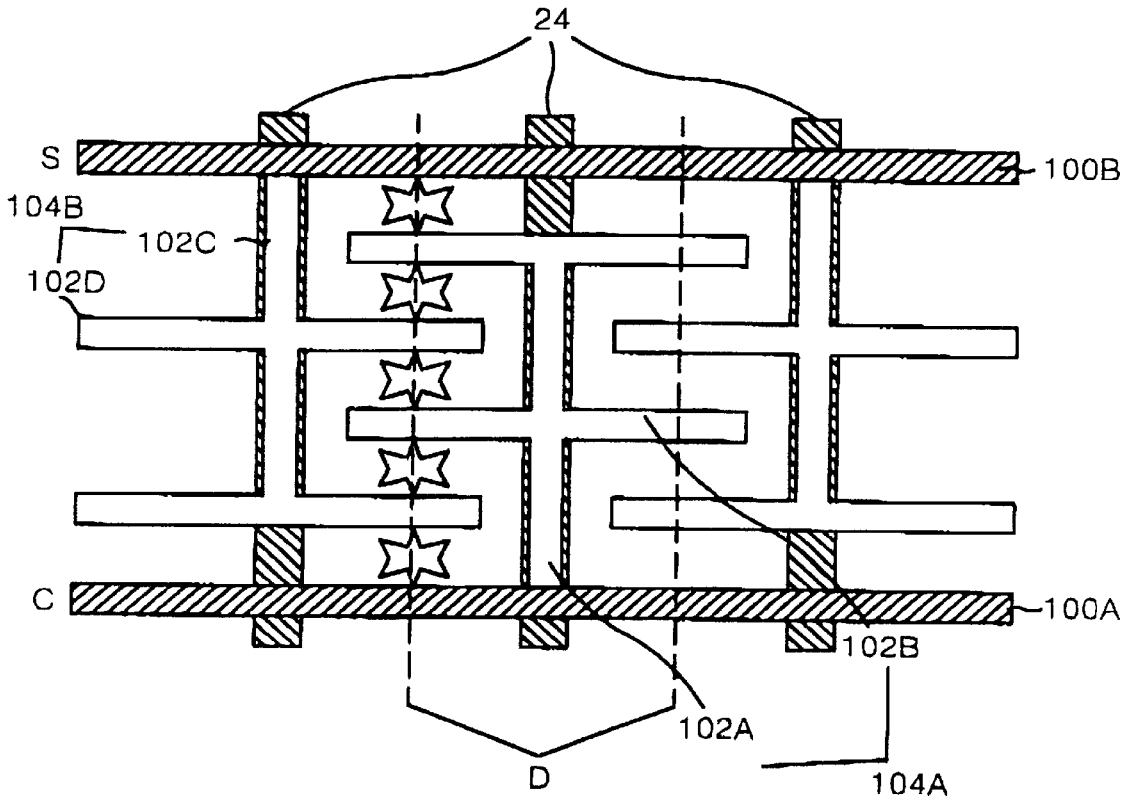

Referring to FIGS. 9A and 9B, a PDP according to a third embodiment of the present invention includes refractive electrodes 104A and 104B having a plurality of second protrusions 102B and 102D. Each of the refractive electrodes 104A and 104B is made from a transparent conductive electrode material or a metal. A sustaining electrode pair 100A and 100B are made from a metal and are connected to first protrusions 102A and 102C of the refractive electrodes 104A and 104B, respectively. The refractive electrodes 104A and 104B are patterned into a tree structure in such a manner that the first protrusions 102A and 102C are extended in the width direction of the sustaining electrode pair 100A and 100B and that the second protrusions 102B and 102D are extended in the longitudinal direction of the sustaining electrode pair 100A and 100B. The first protrusions 102A and 102C are located at a position overlapping with a barrier rib 24, that is, at a boundary between the cells. On the front substrate 40 provided with the refractive electrodes 104A and 104B and the sustaining electrode pair 100A and 100B, a dielectric layer and a protective layer (not shown) are disposed.

In such a structure of the refractive electrodes 104A and 104B, distances between the sustaining electrode pair 100A and 100B and the second protrusions 102B and 102D are equal to a distance between the second protrusions 102B and 102D. Thus, if a sustaining voltage is applied to the sustaining electrode pair 100A and 100B, then a discharge is generated between the sustaining electrode pair 100A and 100B and the second protrusions 102B and 102D and, at the same time, a discharge is generated between the second protrusions 102B and 102D, and such a discharge is gradually diffused all over the cells. In other words, whenever a sustaining pulse is applied, a sustaining discharge is simultaneously initiated at a plurality of positions within the cell. Alternately, the distances between the sustaining electrode pair 100A and 100B and the second protrusions 102B and 102D may be different from the distance between the second protrusions 102B and 102D. In this case, a discharge is initiated between the electrodes having a narrow distance between electrodes and just thereafter a discharge is generated between the electrodes having a relatively wider distance between electrodes.

By the way, in the first embodiment as described earlier, distances between the second protrusions 52B and 52D of the refractive electrodes 54A and 54B or distances between the second protrusions 52B and 52D and the sustaining electrode pair 50A and 50B must be adjusted narrowly so that a stable discharge can be generated at a low voltage. In order to narrow the distance between electrodes, widths of the second protrusions 52B and 52D must be enlarged. However, if the second protrusions 52B and 52D are enlarged, then an aperture ratio is reduced to that extent. As compared with this, the refractive electrodes 104A and 104B shown in FIGS. 9A and 9B have a greater number of second protrusions 102B and 102D to narrow a distance between the electrodes, it is unnecessary to enlarge the second protrusions 102B and 102D.

Figure 10:
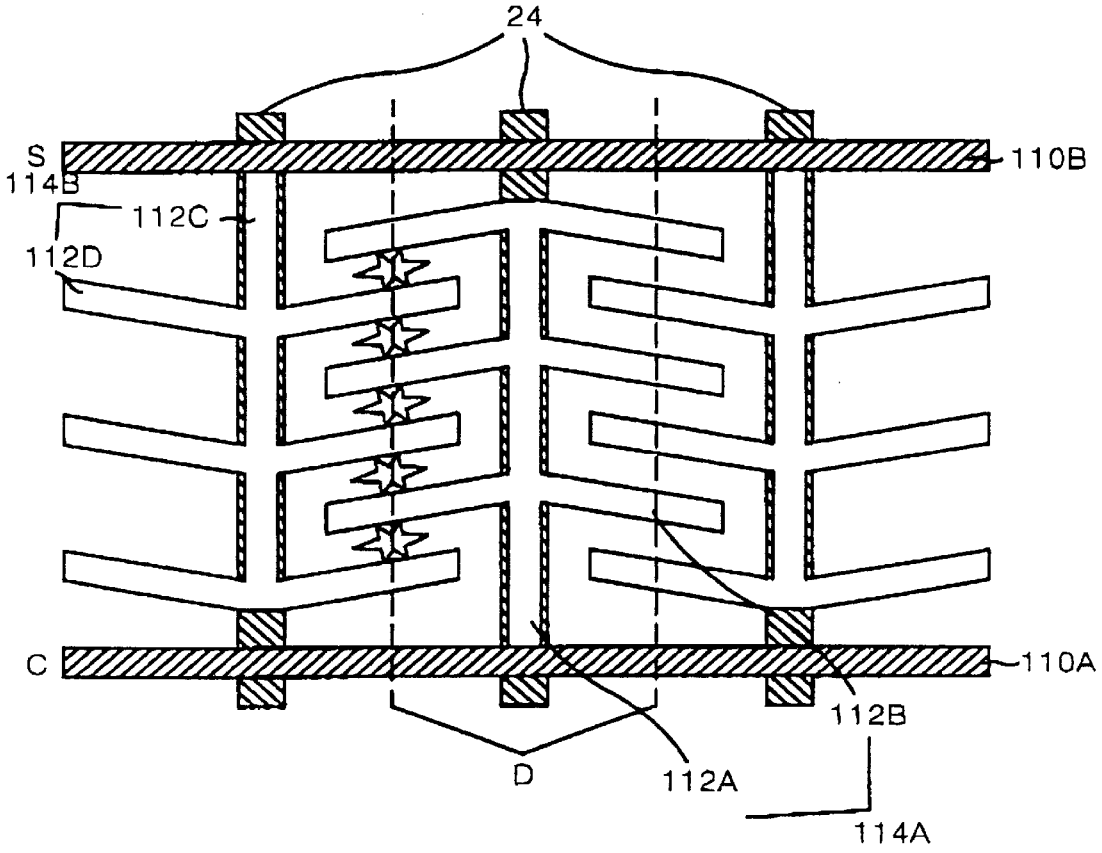

Referring to FIG. 10, a PDP according to a fourth embodiment of the present invention includes refractive electrodes 114A and 114B having a plurality of second protrusions 112B and 112D extended at an incline of a certain angle from first protrusions 112A and 112C. Each of the refractive electrodes 114A and 114B is made from a transparent conductive electrode material or a metal. A sustaining electrode pair 110A and 110B is made from a metal and are connected to first protrusions 112A and 112C of the refractive electrodes 114A and 114B, respectively. The refractive electrodes 114A and 114B are patterned into a tree structure in such a manner that the first protrusions 112A and 112C are extended in the width direction of the sustaining electrode pair 110A and 110B and that the second protrusions 112B and 112D are inclined at a desired angle. The first protrusions 112A and 112C are located at a position overlapping with a barrier rib 24, that is, at a boundary between the cells. On the front substrate 40 provided with the refractive electrodes 114A and 114B and the sustaining electrode pair 110A and 110B, a dielectric layer and a protective layer (not shown) are disposed.

In such a structure of the refractive electrodes 114A and 114B, distances between the second protrusions 112B and 112D are equal. Thus, if a sustaining voltage is applied to the sustaining electrode pair 110A and 110B, then a discharge is generated between the second protrusions 112B and 112D, and is gradually diffused all over the cells.

Such refractive electrodes 114A and 114B has a narrow distance between electrodes because the number of second protrusions 112B and 112D is large, so that it is easy to adjust a distance between electrodes and it is unnecessary to enlarge the second protrusions 112B and 112D. Alternatively, the distances between the second protrusions 112B and 112D may be different.

In such an electrode structure, since the second protrusions 112B and 112D are inclined at a desired angle, they have a larger length than the second protrusions extended in the horizontal direction in the earlier embodiments. Accordingly, a discharge path between the second protrusions 112B and 112D becomes longer and a discharge area becomes larger in comparison to the earlier embodiments.

Figure 11A:
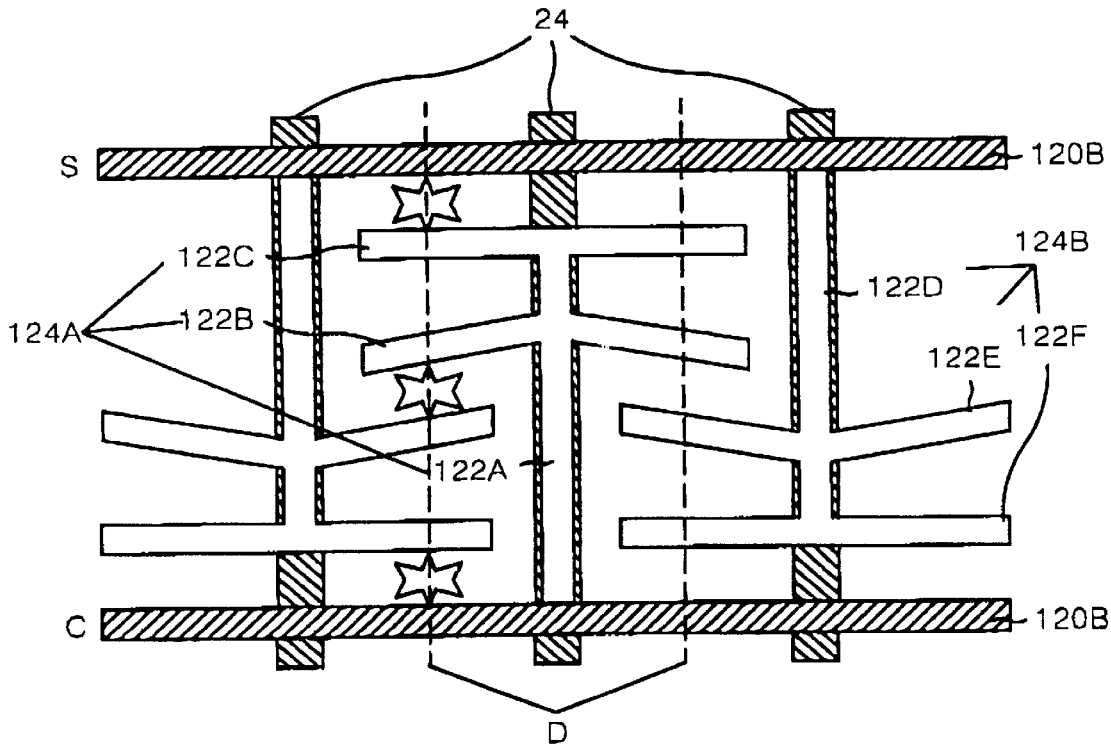
Figure 11B:
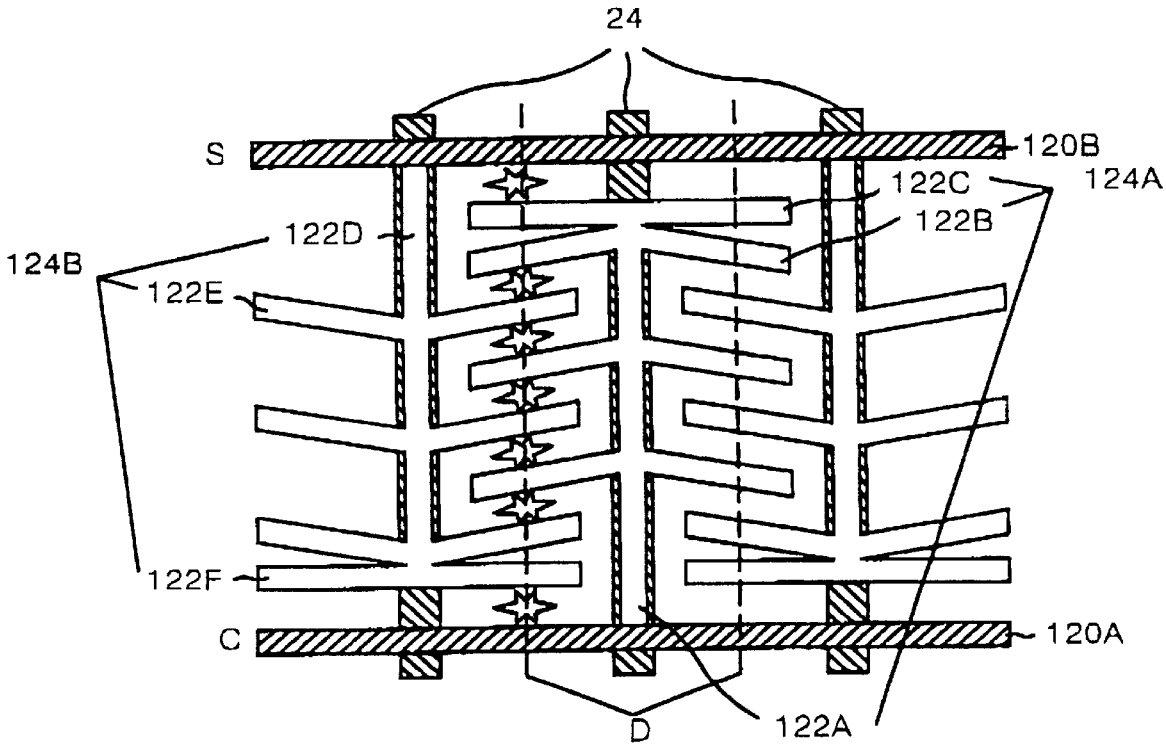
Figure 11C:
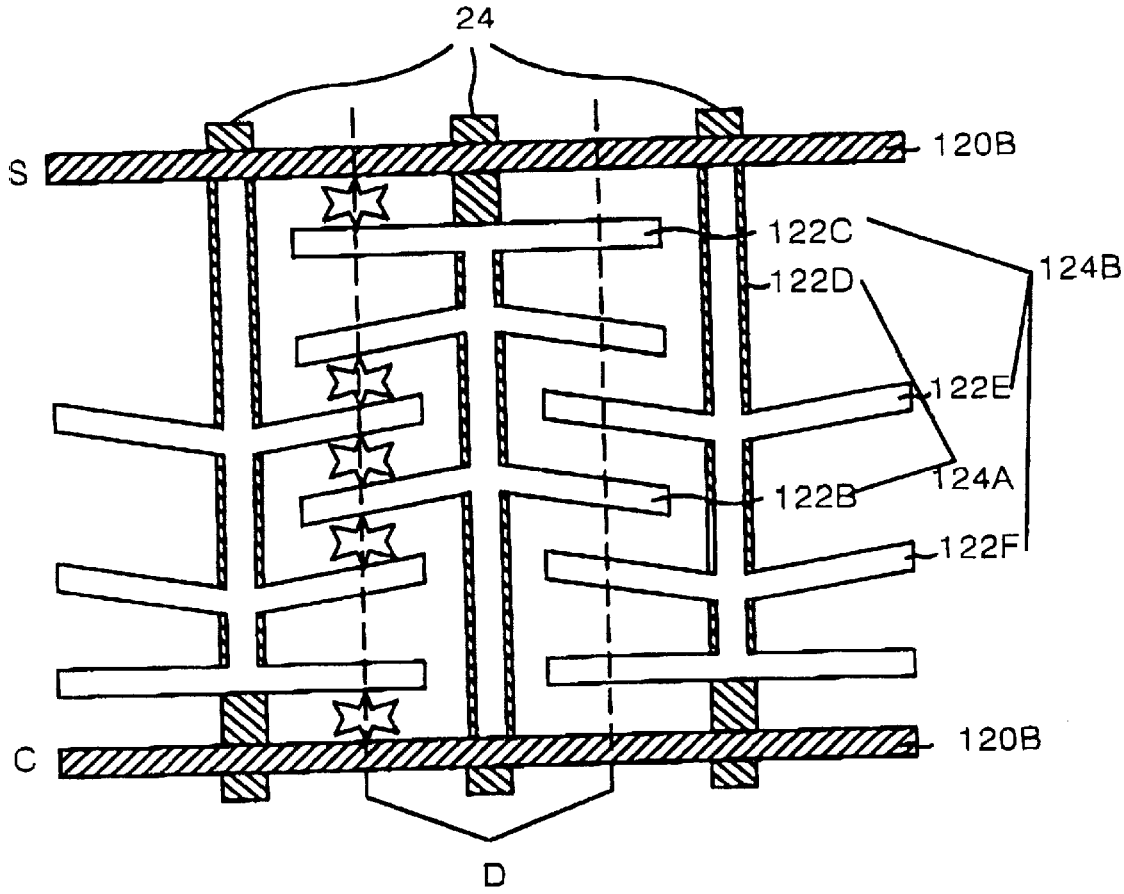

Referring to FIGS. 11A to 11C, a PDP according to a fifth embodiment of the present invention includes refractive electrodes 124A and 124B that have first protrusions 122A and 122D perpendicular to a sustaining electrode pair 120A and 120B, a plurality of second protrusions 122B and 122E extended at an incline of a certain angle from the first protrusions 122A and 122D, and third protrusions 122C and 122F opposed, in parallel, to the sustaining electrode pair 120A and 120B, respectively. Each of the refractive electrodes 124A and 124B is made from a transparent conductive electrode material or a metal. The sustaining electrode pair 120A and 120B are made from a metal and are connected to the first protrusions 122A and 122D of the refractive electrodes 124A and 124B, respectively. The first protrusions 122A and 122C are located at a position overlapping with a barrier rib 24, that is, at a boundary between the cells. On a front substrate 40 provided with the refractive electrodes 124A and 124B and the sustaining electrode pair 120A and 120B, a dielectric layer and a protective layer (not shown) are disposed.

In such a structure of the refractive electrodes 124A and 124B, distances between the second protrusions 122B and 122E are equal to distances between the sustaining electrode pair 120A and 120B and the third protrusions 122C and 122F. Thus, if a sustaining voltage is applied to the sustaining electrode pair 120A and 120B, then a discharge is generated between the second protrusions 122B and 122E and, at the same time, a discharge is generated between the sustaining electrode pair 120A and 120B and the third protrusions 122C and 122F, and such a discharge is gradually diffused all over the cells. Alternately, the distances between the second protrusions 122B and 122E may be different from the distance between the sustaining electrode pair 120A and 120B and the third protrusions 122C and 122F.

As described above, according to the present invention, each of the sustaining electrodes has a refractive structure such that a discharge between the sustaining electrodes is generated at a plurality of positions, thereby simultaneously generating a sustaining discharge at a plurality of positions within the cell. Accordingly, the brightness can be improved. Furthermore, the transparent electrodes are reduced to lower a voltage drop amount caused by the transparent electrodes, so that the power consumption can be reduced.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electrode structure of a plasma display panel having cells including a sustaining electrode pair arranged in a matrix type, said structure comprising:

refractive electrodes connected to the sustaining electrode pair and bent to generate a sustaining discharge at at least two positions within the cell, wherein the refractive electrodes comprises:

a first protrusion connected to the sustaining electrodes in the width direction of the sustaining electrode pair; and at least one of second protrusion extended in the longitudinal direction of the sustaining electrode pair from the first protrusion.

2. The electrode structure as claimed in claim 1, wherein the refractive electrodes are alternately formed in the longitudinal direction of the sustaining electrode pair at each of the sustaining electrodes.

3. The electrode structure as claimed in claim 1, wherein the second protrusion is extended in the longitudinal direction of the sustaining electrode pair from the end of the first protrusion.

4. The electrode structure as claimed in claim 1, wherein the first protrusion is formed at a boundary area between the cells.

5. The electrode structure as claimed in claim 4, wherein the first protrusion overlaps with a barrier rib.

6. The electrode structure as claimed in claim 1, wherein a distance between the sustaining electrode and the second protrusion is equal to a distance between the second protrusions.

7. The electrode structure as claimed in claim 6, wherein a discharge between the second protrusions and a discharge between the second protrusion and the sustaining electrode are generated at the same time.

8. The electrode structure as claimed in claim 1, wherein a distance between the sustaining electrode and the second protrusion is different from a distance between the second protrusions.

9. The electrode structure as claimed in claim 1, wherein the first and second protrusions are made from a transparent conductive material.

10. The electrode structure as claimed in claim 1, wherein the first and second protrusions are made from a metal.

11. The electrode structure as claimed in claim 1, wherein the first protrusion is made from a metal, and the second protrusion is made from a transparent conductive material.

12. The electrode structure as claimed in claim 1, wherein the sustaining electrode pair is made from a metal.

13. The electrode structure as claimed in claim 1, wherein each of the refractive electrodes further comprises:

at least one of third protrusion extended at an incline of a desired angle from the first protrusion.

14. The electrode structure as claimed in claim 13, wherein a distance between the third protrusions is equal.

15. The electrode structure as claimed in claim 13, wherein the third protrusion is made from a transparent conductive material.

16. The electrode structure as claimed in claim 13, wherein the third protrusion is made from a metal.

17. An apparatus comprising:

a first electrode; and a second electrode, wherein at least a portion of the first electrode surrounds at least a portion of the second electrode, wherein at least a portion of the first electrode and at least a portion of the second electrode are substantially parallel, and wherein distance between said at least a portion of the first electrode and at least a portion of the second electrode that are substantially parallel is smaller or equal to any other distance between the first electrode and the second electrode.

18. The apparatus of claim 17, wherein the apparatus is a plasma display.

19. The apparatus of claim 17, wherein the first electrode and the second electrode are on substantially the same spatial plane.

20. The apparatus of claim 17, wherein the first electrode comprises at least two electrically coupled sections.

21. The apparatus of claim 20, wherein at least one of said at least two electrically coupled section comprises a transparent conductive material.

22. The apparatus of claim 21, wherein the transparent conductive material is at least one of indium zinc oxide and indium tin oxide.

23. The apparatus of claim 17, wherein the second electrode comprises at least two electrically coupled sections.

24. The apparatus of claim 23, wherein at least one of said at least two electrically coupled section comprises a transparent conductive material.

25. The apparatus of claim 24, wherein the transparent conductive material is at least one of indium zinc oxide and indium tin oxide.

26. The apparatus of claim 17, wherein the first electrode and the second electrode are both sustaining electrodes.

27. The apparatus of claim 26, wherein:

the first electrode is a scanning electrode; and the second electrode is a common electrode.

* * * * *